US006938438B2

(12) United States Patent
Lifson et al.

(10) Patent No.: US 6,938,438 B2
(45) Date of Patent: Sep. 6, 2005

(54) VAPOR COMPRESSION SYSTEM WITH BYPASS/ECONOMIZER CIRCUITS

(75) Inventors: Alexander Lifson, Manlius, NY (US); Michael F. Taras, Fayetteville, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/419,509

(22) Filed: Apr. 21, 2003

(65) Prior Publication Data

US 2004/0206110 A1 Oct. 21, 2004

(51) Int. Cl.[7] ..... F25B 1/00; F25B 41/00; F25B 49/00

(52) U.S. Cl. ..... 62/498; 62/196.1

(58) Field of Search ..... 62/498, 196.1

(56) References Cited

U.S. PATENT DOCUMENTS

| | | | | |
|---|---|---|---|---|
| 3,899,897 A | * | 8/1975 | Boerger et al. | 62/196.1 |
| 4,811,568 A | * | 3/1989 | Horan et al. | 62/200 |
| 5,582,022 A | * | 12/1996 | Heinrichs et al. | 62/175 |
| 5,768,901 A | * | 6/1998 | Dormer et al. | 62/175 |
| 5,996,364 A | | 12/1999 | Lifson et al. | |
| 6,058,729 A | * | 5/2000 | Lifson et al. | 62/217 |
| 6,138,467 A | * | 10/2000 | Lifson et al. | 62/217 |
| 6,347,528 B1 | | 2/2002 | Iritani et al. | |
| 6,446,446 B1 | * | 9/2002 | Cowans | 62/117 |

FOREIGN PATENT DOCUMENTS

| | | |
|---|---|---|
| JP | 2000249413 | 9/2000 |
| JP | 2003074999 | 12/2003 |

* cited by examiner

*Primary Examiner*—Cheryl Tyler
*Assistant Examiner*—Filip Zec
(74) *Attorney, Agent, or Firm*—Bachman & LaPointe, PC

(57) ABSTRACT

A vapor compression system includes a main circuit comprising a compressor, a condenser, an expansion device and an evaporator serially connected by main refrigerant lines, the compressor having a suction port, a discharge port and an intermediate pressure port; an economizer circuit having an auxiliary expansion device and economizer refrigerant lines connected between said condenser and at least one of said intermediate pressure port and said suction port of said compressor; a bypass circuit having bypass refrigerant lines connected between the intermediate pressure port and the suction port; and a heat exchanger adapted to receive a first flow from the main refrigerant lines and a second flow from at least one of the economizer circuit and the bypass circuit, the first flow and the second flow being positioned for heat transfer relationship within the heat exchanger, wherein the system is selectively operable in a first mode wherein the economizer circuit is active and the bypass circuit is inactive, and a second mode wherein the bypass circuit is active and the economizer circuit is inactive, and wherein the heat exchanger is active for cooling the first flow in both the first mode and the second mode. Further, another system configuration is offered which allows multiple additional important modes of operation as well as enhanced efficiency and reliability and operational envelope expansion through selective valving arrangements.

8 Claims, 2 Drawing Sheets

VAPOR COMPRESSION SYSTEM WITH BYPASS/ECONOMIZER CIRCUITS

BACKGROUND OF THE INVENTION

The invention relates to vapor compression systems and, more particularly, to vapor compression systems utilizing an improved configuration of bypass refrigerant circuit and control features so as to provide enhanced system performance at part-load operation, thus improving life-cycle cost of the unit.

Vapor compression systems often use compressors such as scroll compressors, screw compressors, two-stage reciprocating compressors and the like. Such compressors may have an intermediate pressure port for operating in an unloaded mode, for example when capacity reduction is desired to match external load, or in an economized mode, when performance boost is desirable.

Unfortunately, when operating typical compression systems in unloaded modes, efficiency is not as good as is desirable.

Thus, the need remains for vapor compression systems which can be operated in unloaded modes with enhanced efficiency without compromising full-load operation.

It is therefore the primary object of the present invention to provide such a system.

It is a further object of the invention to provide such a system wherein equipment cost is not increased.

Other objects and advantages of the present invention will appear hereinbelow.

SUMMARY OF THE INVENTION

In accordance with the present invention, the foregoing objects and advantages have been readily attained.

According to the invention, a vapor compression system is provided which comprises a main compression circuit comprising a compressor, a condenser, an expansion device and an evaporator serially connected by main refrigerant lines, said compressor having a suction port, a discharge port and an intermediate pressure port; an economizer circuit comprising an auxiliary expansion device and economizer refrigerant lines connected between said condenser and at least one of said intermediate pressure port and said suction port of said compressor; a bypass circuit comprising bypass refrigerant lines connected between said intermediate pressure port and said suction port; and a heat exchanger adapted to receive a first flow from said main refrigerant lines and a second flow from at least one of said economizer circuit and said bypass circuit, said first flow and said second flow being positioned for heat transfer relationship in said heat exchanger, wherein said system is selectively operable in a first mode wherein said economizer circuit is active and said bypass circuit is inactive, and a second mode wherein said bypass circuit is active and said economizer circuit is inactive, and wherein said heat exchanger is active for cooling said first flow in both said first mode and said second mode of operation.

Still further, a control member can be provided and advantageously operatively associated with a bypass shutoff valve and an economizer shutoff valve and utilized for selectively controlling these valves to provide operation in the level or mode which is desired. These valves, and additional lines and valves, can be utilized to provide a plurality of different modes of operation as desired.

BRIEF DESCRIPTION OF THE DRAWINGS

A detailed description of preferred embodiments of the present invention follows, with reference to the attached drawings, wherein.

DETAILED DESCRIPTION

The invention relates to vapor compression systems and, more particularly, to vapor compression systems with an efficient connection of bypass and economizer circuits which advantageously allows for enhanced operation in unloaded modes, as well as multiple levels of unloading.

The disclosure that follows is given in terms of a vapor compression system which represents a preferred embodiment of the invention. There are configurations of the system as noted below which may be operable to provide two-phase flow to the compressor. Such flow is acceptable with certain types of compressor, and such systems are considered to be vapor compression systems as used herein and well within the scope of the present invention.

Figure 1:
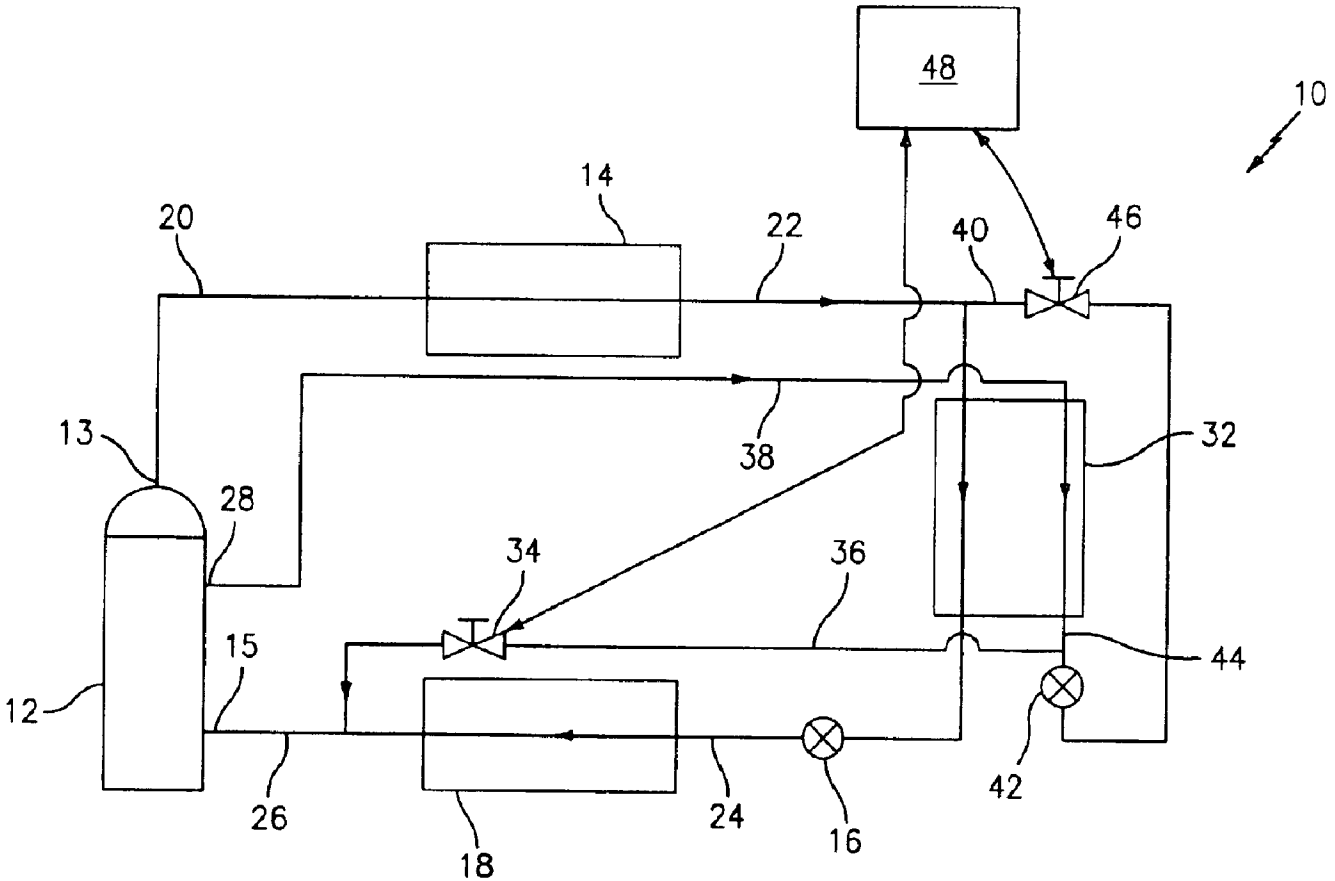
FIG. 1 schematically illustrates a system in accordance with the present invention.

FIG. 1 shows a vapor compression system 10 in accordance with the present invention. Vapor compression system 10 includes a main vapor compression circuit including a compressor 12, a condenser 14, an expansion device 16 and an evaporator 18. These components are serially connected by main refrigerant lines to provide refrigerant flow from discharge port 13 of compressor 12 through line 20 to condenser 14, from condenser 14 through line 22 to expansion device 16, from expansion device 16 through line 24 to evaporator 18, and from evaporator 18 through line 26 back to a suction port 15 of compressor 12.

An economizer circuit is also provided and is connected between condenser 14 and at least one of an intermediate pressure port 28 and suction port 15 of compressor 12. This circuit is preferably provided in the form of an economizer refrigerant line 40 leading from condenser 14 to an auxiliary expansion device 42, and from expansion device 42 through economizer refrigerant line 44 to heat exchanger 32. In a typical mode of operation of the economizer circuit, the economizer circuit extends from heat exchanger 32 through line 38 to an intermediate pressure port 28 of compressor 12.

An economizer shutoff valve 46 can advantageously be positioned along economizer refrigerant lines, for example along line 40, for selectively allowing and blocking flow through the economizer circuit as well. Alternatively, if expansion device 42 is an electronic expansion device, then valve 40 is not needed.

In further accordance with the invention, system 10 also includes a bypass circuit which is connected between an intermediate pressure port 28 of compressor 12 and suction port 15 of compressor 12. The bypass circuit allows for unloaded operation of compressor 12. According to the invention, and advantageously, the bypass circuit is adapted to flow through economizer heat exchanger 32 so as to sub-cool the main refrigerant flow with flow from the bypass circuit, thus utilizing economizer heat exchanger 32, and improving efficiency, during unloaded operation. Thus, according to the invention, bypass refrigerant line 38 advantageously leads to economizer heat exchanger 32, and from heat exchanger 32 through line 36 and back to suction portion 15 of compressor 12. A bypass shutoff valve 34 is advantageously positioned along bypass line 36 leading from heat exchanger 32 to suction port 15, for selectively allowing and blocking flow through the bypass circuit.

It should be noted that reference is made through this text to blocking flow through certain circuits or components. As used herein, this term means substantially blocking of flow, such that the circuit in question is substantially inactive, or such that the substantial portion of flow through that circuit is blocked.

In further accordance with the invention, main refrigerant line 22 flows through economizer heat exchanger 32 so as to be exposed to heat transfer relationship with flow in line 38 in heat exchanger 32. Thus, heat exchanger 32 is adapted to receive a first flow from main refrigerant line 22 and a second flow from at least one of the economizer circuit and the bypass circuit, and heat transfer occurs in both full-load economized operation, and advantageously in part-load operation as well.

With this configuration, and advantageously, when compressor 12 is to be operated in an unloaded state, valve 34 is open to pass a portion of the refrigerant through intermediate pressure port 28, representing a portion of refrigerant flowing through compressor 12 which is compressed to an intermediate pressure, thereby unloading compressor 12.

In the unloaded mode of operation, main refrigerant flow is sub-cooled in economizer heat exchanger 32 to provide performance enhancement of the system in this mode of operation. In this regard, depending upon location of intermediate pressure port 28, the intermediate pressure of flow exiting this port is relatively close to suction pressure, thereby increasing available temperature difference for heat transfer interaction in economizer heat exchanger 32.

In further accordance with the invention, a control member 48 may advantageously be provided and operatively associated with shutoff valves 34, 46, or expansion device 42 if electronically controlled, for selectively positioning either of these valves in the closed or open position so as to allow for operation of system 10 as desired, in the full load economized mode or in the unloaded mode, with heat exchanger 32 still active and functional to enhance system performance. Of course, system 10 can also operate in a full load non-economized mode with both valves 34, 46 closed.

Figure 2:
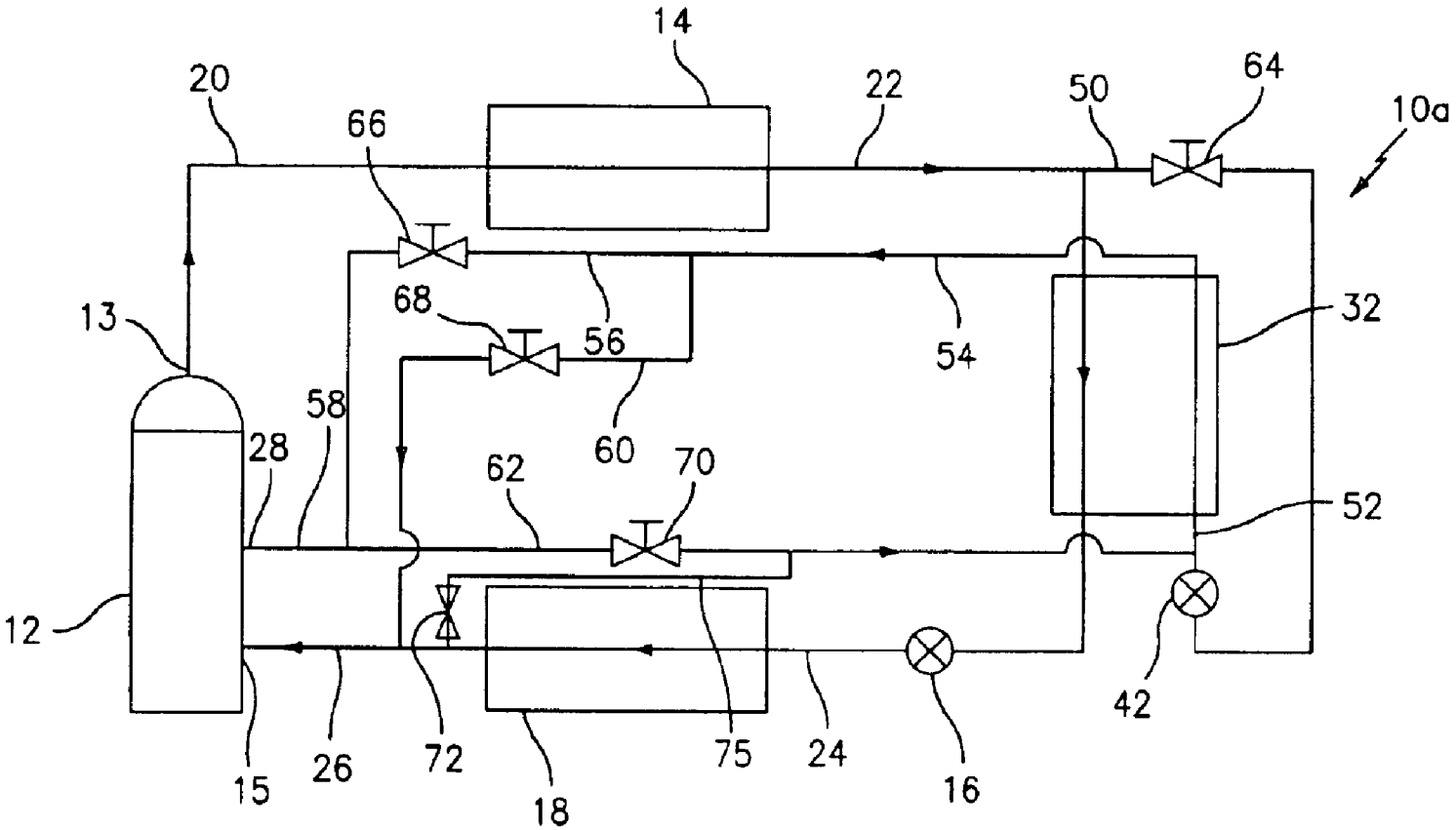
FIG. 2 schematically illustrates another embodiment of a system in accordance with the present invention.

Referring now to FIG. 2, a further embodiment of the present invention is illustrated wherein additional lines and valves are provided to allow additional different modes of operation of the system. This is particularly advantageous in that it allows the system to be operated to more closely match the external load, and further can be used to broaden the operational envelope of the system. A benefit stemming from this functionality is that switching between on and off modes of the system is reduced, thereby enhancing the long-term reliability of the system as well.

It should be appreciated that the economizer and bypass circuits described herein can in fact be considered to be circuit portions since they contain flow lines and/or components which themselves may not provide a closed loop. As used herein, however, the term circuit specifically includes circuit elements, portions or segments thereof. Additionally, economizer and bypass circuits may share components that function differently in these modes of operation.

FIG. 2 shows a system 10*a* wherein similar components, that is, compressor 12, condenser 14, expansion device 16 and evaporator 18 are present. As in the embodiment of FIG. 1, these components are connected by main refrigerant lines 20, 22, 24 and 26 to define the main refrigerant circuit.

System 10*a* has an economizer circuit, a bypass circuit, an economizer heat exchanger 32 and an auxiliary expansion device 42 which are connected by a series of lines and valves to provide for a plurality of different modes of operation as further described below.

Also in this embodiment, compressor 12 has a discharge port 13 an intermediate port 28 and a suction port 15, and a bypass circuit is communicated between intermediate port 28 and suction port 15, also through a series of lines and valves to provide for a plurality of different modes of operation as further described below.

In this embodiment, additional flow lines and valves are provided to allow for a plurality of different modes of operation, nine of which are of importance and are discussed herein. Three of these modes of operation are as discussed above in FIG. 1, that is, a normal mode of operation with both the economizer and bypass circuit inactive, a bypass only mode of operation wherein the bypass circuit is active and the economizer circuit is inactive, and an economizer only mode wherein the economizer circuit is active and the bypass circuit is inactive. As will be better understood from the following discussion, through additional flow lines and appropriate control of valves positioned on these lines, six additional significant modes of operation are provided. These include four modes of operation where the economizer circuit and bypass circuit are both active, with different portions of flow, or no flow, passing through heat exchanger 32, as well as a bypass or unloaded mode of operation with no flow passing through heat exchanger 32, and a bypass or unloaded mode of operation with bypass flow through heat exchanger 32 in counter flow with main refrigerant line 22, as opposed to the parallel flow arrangement provided in FIG. 1

It is preferred that the system of the present invention be adapted to allow operation in at least three of the nine different modes of operation identified herein.

As will be set forth below three of these modes of operation allow for creating a controlled flooding condition at the suction port or inlet of the compressor. Under controlled circumstances, this can be desirable as a way to avoid superheat in the feed to the compressor and thereby reduce compressor discharge temperature. Thus, the system and method of the present invention are preferably adapted to allow operation in at least one of these three modes.

These lines and valves and their use to provide additional modes of operation are as follows.

FIG. 2 shows the economizer circuit extending from main refrigerant line 22 through line 50 to auxiliary expansion device 42, from auxiliary expansion device 42 along line 52 to economizer heat exchanger 32, and from economizer heat exchanger 32 along line 54 to a branch where line 56 leads to line 58 and intermediate port 28 of compressor 12, while line 60 leads to main refrigerant line 26 and suction port 15 of compressor 12 as shown.

In addition, there are lines for defining the bypass circuit which flows from intermediate port 28 through line 58 to the branch with line 56 and a line 62 which joins line 52 near economizer heat exchanger 32, and line 75 which connects lines 62 and 26. In addition to these lines, valves 64, 66, 68, 70 and 72 are positioned along certain lines as described below, and the opening and closing of these valves allows for operation of system 10*a* in the six additional different modes identified above.

Valve 64 is positioned along line 50 as shown, while valve 66 is positioned along line 56, valve 68 is positioned along line 60, valve 70 is positioned along line 62 and valve 72 is positioned along line 75 also substantially as shown.

In a normal mode of operation, also described in connection with FIG. 1, all valves are substantially closed, and main flow within system 10*a* is through main refrigerant lines 20, 22, 24 and 26 as described above. Compressor 12 in this mode is operated in a fully loaded state, and economizer heat exchanger 32 is substantially inactive.

In a bypass only mode, valves 64, 66 and 72 are substantially closed and valves 68 and 70 are open. This substantially inactivates the economizer circuit, but provides for flow through the bypass circuit which exits intermediate port 28 through line 58 and travels through line 62, valve 70 and line 52 to economizer heat exchanger 32 which is utilized to further sub-cool main refrigerant flow in line 22. This bypass flow then exits economizer heat exchanger 32 through line 54 and line 60 and passes through valve 68 to line 26 and suction port 15 of compressor 12. In this mode, and advantageously, compressor 12 is unloaded while performance of the system is still improved through functioning of economizer heat exchanger 32. Further, in this mode, heat exchanger 32 is operated in counter current flow configuration as compared to the co-current flow configuration provided in the embodiment of FIG. 1.

In an economizer only mode of operation, valves 64 and 66 are open while valves 68, 70 and 72 are substantially closed. In this mode of operation, the economizer circuit is functional and refrigerant flows from main refrigerant line 22 through line 50 and valve 64 to auxiliary expansion device 42. Flow then travels from auxiliary expansion device 42 through line 52 to economizer heat exchanger 32, and then through line 54 and valve 66 to line 58 and into intermediate port 28 of compressor 12. From this description, and considering the bypass only mode described above, it should readily be clear that intermediate port 28 in this embodiment can be functional as either an inlet to or outlet from compressor 12. In this regard, compressor 12 can be provided such that intermediate port is a single port providing both functions, or can be provided with two different ports, one specifically adapted for discharge and the other specifically adapted for suction at some intermediate pressure. Either of these configurations, and alterations thereon, are considered well within the scope of the present invention.

As set forth above, the embodiment of FIG. 2 provides for additional modes where both circuits are active. In the first mode where both circuits are active, valves 64, 66 and 68 are open and valves 70 and 72 are closed so that economizer heat exchanger 32 is functional with flow from the economizer circuit, and the bypass circuit is active for unloading compressor 12. Specifically, in this configuration, flow in the economizer circuit travels from main refrigerant line 22 through line 50, valve 64, auxiliary expansion device 42 and line 52 to economizer heat exchanger 32 as in other embodiments. From economizer heat exchanger 32, economizer flow exits through line 54 and flows through line 60, valve 68 and main refrigerant line 26 to suction port 15 of compressor 12. The bypass circuit in this mode of operation is also functional, and bypass flow exits intermediate port 28 through line 58 and passes through valve 66 to line 56. Bypass flow in line 56 joins economizer flow in line 54 and this combined flow passes through line 60, valve 68 and main refrigerant line 26 to suction port 15 of compressor 12.

In another mode of operation wherein both circuits are functional, valves 64, 68 and 70 are open and valves 66 and 72 are substantially closed. In this mode of operation, both the bypass and economizer circuits are functional, and a combined bypass/economizer flow is passed through economizer heat exchanger 32 for sub-cooling refrigerant in main refrigerant line 22 as desired. In this mode of operation, the economizer circuit functions with flow from main refrigerant line 22 through line 50, valve 64, auxiliary expansion device 42 and line 52 to economizer heat exchanger 32. Flow through the bypass circuit exits intermediate port 28 through lines 58 and 62 and through valve 70 to join economizer flow in line 52 upstream of economizer heat exchanger 32. The combined economizer and bypass flow then passes through economizer heat exchanger 32 for heat exchange interaction with the main refrigerant flow in line 22, and exits through line 54. This flow then travels through line 60, valve 68 and main refrigerant line 26 back to suction port 15 of compressor 12. This mode of operation may be considered to be a controlled flooding condition at suction port 15 of compressor 12, which is beneficial for reducing compressor discharge temperature and expanding the system operating envelope.

In another mode of operation, valves 64, 66 and 72 are open and valves 68 and 70 are substantially closed. In this case bypass flow only is employed for heat transfer interaction in economizer heat exchanger 32, while flow through the economizer circuit passes from expansion device 42 through line 75 and valve 72 to suction port 15. As in a previous mode of operation, a controlled flooding condition can be employed to obtain additional benefits. It should be noted that an identical mode of operation can be realized by opening both valves 34 and 46 in the embodiment of FIG. 1.

In another bypass mode of operation, valves 66 and 68 or 70 and 72 are open and the other valves are substantially closed. This allows the bypass circuit to be operated as a conventional bypass circuit, with unloading of the compressor without use of the economizer heat exchanger.

In still another mode of operation, valves 64, 70 and 72 can be open while valves 66 and 68 are substantially closed. This provides for flow through the economizer circuit and the bypass circuit, without flow through heat exchanger 32, which provides an additional level of unloading of compressor 12 if desired. As above, controlled flooding condition can also be implemented in this case.

It should readily be appreciated that valves 64, 66, 68, 70 and 72 can readily be controlled by a control member 48 such as that described in connection with FIG. 1, and that control member 48 can be adapted to sense or detect information related to various compressor operating parameters, and utilize such information to select an appropriate mode of operation, and to send control signals to the various valves to adopt that specific selected mode of operation. As set forth above, this is particularly advantageous as the multiple modes of operation allow for a more close matching of operational mode of system 10, 10*a* in accordance with the present invention with the external load, and further allows for a broader operational envelope of the system, and fewer start/stops of the system, thereby further enhancing system reliability as well.

It should be appreciated that the system in accordance with the present invention advantageously allows for multiple stages of unloaded operation, and further enhances the efficiency of operation in each of these modes.

It should also be appreciated that particular benefits in accordance with the present invention are obtained in some instances (FIG. 1) with no additional hardware required, and that this system can be utilized in conjunction with any type of expansion device for expansion devices 16, 42. Further, auxiliary expansion device 42 may be provided as an electronic flow control device which can be used to control flow through the portion of the circuits of FIGS. 1 and 2 without the need for valves 46, 64 respectively.

This system is especially useful in open-drive systems, where additional motor heat is not absorbed by low-pressure refrigerant, thus increasing available temperature difference for further sub-cooling of the of the main refrigerant flow in heat exchanger 32.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A vapor compression system, comprising:

a main circuit comprising a compressor, a condenser, an expansion device and an evaporator serially connected by main refrigerant lines, said compressor having a suction port, a discharge port and an intermediate pressure port;

an economizer circuit comprising an auxiliary expansion device and economizer refrigerant lines connected between said condenser and at least one of said intermediate pressure port and said suction port of said compressor;

a bypass circuit comprising bypass refrigerant lines connected between said intermediate pressure port and said suction port; and a heat exchanger adapted to receive a first flow from said main refrigerant lines and a second flow selectively from said economizer circuit and said bypass circuit, said first flow and said second flow being positioned for heat transfer relationship within said heat exchanger, wherein said system is selectively operable in a first mode wherein said economizer circuit is active and flows through said heat exchanger and said bypass circuit is inactive, and a second mode wherein said bypass circuit is active and flows through said heat exchanger and said economizer circuit is inactive, and wherein said heat exchanger is active for cooling said first flow in both said first mode and said second mode.

2. The system of claim 1, further comprising a bypass shutoff valve positioned along said bypass refrigerant lines for selectively allowing and blocking flow through said bypass circuit and an economizer shutoff valve for selectively allowing and blocking flow through said economizer circuit, whereby said system is selectively operable in said first mode and said second mode.

3. The system of claim 2, further comprising a control member operatively associated with said bypass shutoff valve and said economizer shutoff valve for selectively opening and closing said bypass shutoff valve and said economizer shutoff valve.

4. The system of claim 1, further comprising means for selectively controlling flow through said economizer circuit and said bypass circuit whereby said system can be operated in said first mode, said second mode wherein flows in said heat exchanger are substantially co-current, a third mode wherein said economizer circuit and said bypass circuit are substantially inactive, and at least one additional mode selected from the group consisting of a fourth mode wherein said economizer circuit and said bypass circuit are both active, and said second flow comprises flow from both of said economizer circuit and said bypass circuit, a fifth mode wherein said economizer circuit and said bypass circuit are both active, and said second flow comprises flow only from said economizer circuit, a sixth mode wherein said economizer circuit and said bypass circuit are both active, and said second flow comprises flow only from said bypass circuit, a seventh mode wherein said economizer circuit and said bypass circuit are both active, bypass said heat exchanger, and flow to said suction port of said compressor, an eighth mode wherein said economizer circuit is inactive and said bypass circuit is active, wherein said bypass circuit bypasses said heat exchanger and flows to said suction port of said compressor, and a ninth mode wherein said economizer circuit is inactive and said bypass circuit is active, wherein said second flow comprises flow from said bypass circuit, and wherein flow in said heat exchanger is substantially counter-circuit.

5. The system of claim 4, wherein said means for selectively controlling is adapted to allow operation of said system in each of said first mode, said second mode, said third mode, said fourth mode, said fifth mode, said sixth mode, said seventh mode, said eighth mode and said ninth mode.

6. A method for operating a vapor compression system comprising a main vapor compression circuit having a compressor, a condenser, an expansion device and an evaporator serially connected by main refrigerant lines, said compressor having a suction port, a discharge port and an intermediate pressure port; an economizer circuit having an auxiliary expansion device and economizer refrigerant lines connected between said condenser and at least one of said intermediate pressure port and said suction port of said compressor; a bypass circuit having bypass refrigerant lines connected between said intermediate pressure port and said suction port; and a heat exchanger adapted to receive a first flow from said main refrigerant lines and a second flow selectively from said economizer circuit and said bypass circuit, said first flow and said second flow being positioned in heat transfer relationship within said heat exchanger, comprising selectively operating said system in a first mode wherein said economizer circuit is active and flows through said heat exchanger and said bypass circuit is inactive, and a second mode wherein said bypass circuit is active and flows through said heat exchanger and said economizer circuit is inactive, and wherein said heat exchanger is active for cooling flow in said main refrigerant lines in both said first mode and said second mode.

7. A method for operating a vapor compression system comprising a main vapor compression circuit having a compressor, a condenser, an expansion device and an evaporator serially connected by main refrigerant lines, said compressor having a suction port, a discharge port and an intermediate pressure port; an economizer circuit having an auxiliary expansion device and economizer refrigerant lines connected between said condenser and at least one of said intermediate pressure port and said suction port of said compressor; a bypass circuit having bypass refrigerant lines connected between said intermediate pressure port and said suction port.; and a heat exchanger adapted to receive a first flow from said main refrigerant lines and a second flow selectively from said economizer circuit and said bypass circuit, said first flow and said second flow being positioned in heat transfer relationship within said heat exchanger, comprising selectively operating said system in at least three different modes selected from the group consisting of a first mode wherein said economizer circuit is active and flows through said heat exchanger and said bypass circuit is inactive, a second mode wherein said bypass circuit is active and flows through said heat exchanger and said economizer circuit is inactive and flows in said heat exchanger are substantially co-current, a third mode wherein said economizer circuit and said bypass circuit are substantially inactive, a fourth mode wherein said economizer circuit and said bypass circuit are both active, and said second flow comprises flow from both of said economizer circuit and said bypass circuit, a fifth mode wherein said economizer circuit and said bypass circuit are both active, and said second flow comprises flow only from said economizer circuit, a sixth mode wherein said economizer circuit and said bypass circuit are both active, and said second flow comprises flow only from said bypass circuit, a seventh mode wherein said economizer circuit and said bypass circuit are both active, bypass said heat exchanger, and flow to said suction port of said compressor, an eighth mode wherein said economizer circuit is inactive and said bypass circuit is active, wherein said bypass circuit bypasses said heat exchanger and flows to said suction port of said compressor, and a ninth mode wherein said economizer circuit is inactive and said bypass circuit is active, wherein said second flow comprises flow from said bypass circuit, and wherein flow in said heat exchanger is substantially counter-circuit.

8. The method of claim 7, wherein said at least three different modes include at least one of said fourth mode, said sixth mode and said seventh mode whereby a controlled flooding condition can be created at said suction port of said compressor.

* * * * *